US011293714B2

(12) United States Patent
Balhan et al.

(10) Patent No.: US 11,293,714 B2
(45) Date of Patent: Apr. 5, 2022

(54) TRIGGER SAFETY OF A PISTOL

(71) Applicant: FN HERSTAL S.A., Herstal (BE)

(72) Inventors: Laurent Balhan, Mormont (BE); Dorian Delvaux, Oupeye (BE)

(73) Assignee: FN Herstal S.A.

( * ) Notice: Subject to any disclaimer, the term of this patent is extended or adjusted under 35 U.S.C. 154(b) by 0 days.

(21) Appl. No.: 17/238,344

(22) Filed: Apr. 23, 2021

(65) Prior Publication Data

US 2021/0333058 A1 Oct. 28, 2021

(30) Foreign Application Priority Data

Apr. 23, 2020 (EP) ..... 20171205

(51) Int. Cl.
*F41A 17/46* (2006.01)
*F41A 3/66* (2006.01)

(52) U.S. Cl.
CPC ..... *F41A 17/46* (2013.01); *F41A 3/66* (2013.01)

(58) Field of Classification Search
CPC ..... F41A 17/46
USPC ..... 42/70.06
See application file for complete search history.

(56) References Cited

U.S. PATENT DOCUMENTS 1,081,648 A * 12/1913 Mauser ..... B01D 35/005 210/434
4,962,605 A * 10/1990 Aigner ..... F41A 17/46 42/69.01
9,970,724 B1 * 5/2018 Acker ..... F41A 17/46
11,079,193 B1 * 8/2021 Niswander ..... F41A 17/46
2017/0299305 A1 * 10/2017 Bubits ..... F41A 17/46
2018/0094891 A1 * 4/2018 Geissele ..... F41A 17/46
2018/0238651 A1 * 8/2018 Kilic ..... F41A 17/46
2021/0302117 A1 * 9/2021 Bloomfield ..... F41A 19/10

FOREIGN PATENT DOCUMENTS

WO 2015157753 10/2015

* cited by examiner

*Primary Examiner* — Reginald S Tillman, Jr.
(74) *Attorney, Agent, or Firm* — Williams Mullen; Thomas F. Bergert

(57) ABSTRACT

The present invention relates to a firearm comprising a trigger safety, said firearm comprising a frame and a trigger (3), the trigger (3) being positioned on a trigger axis (6) positioned on a trigger lever (4) commanding an ignition chain, said trigger lever (3) being positioned on a trigger lever axis (7) fixed to the frame, said trigger lever (3) being able to switch from an idle position to a position triggering a shot and said trigger (3) being able to switch from an idle position where the trigger bears on the trigger lever on a first bearing surface (11) and a firing position where the trigger (3) bears on the trigger lever (4) on a second bearing surface (10), resilient means (5) keeping the trigger (3) in the idle position when no pressure is applied thereto, characterized in that said trigger (3) comprises a trigger blocking surface (2) bearing on a corresponding blocking element (1) on the frame blocking the rotation of the trigger lever (4) when the trigger (3) is idle and said trigger blocking surface (2) retracting when the trigger rotates on its axis (6) relative to the trigger lever (4), freeing the rotation of the trigger lever (4).

5 Claims, 2 Drawing Sheets

TRIGGER SAFETY OF A PISTOL

RELATED APPLICATIONS

The following application claims priority to European Application No. 20171205.6 filed Apr. 23, 2020, the disclosure of which is incorporated herein by reference in its entirety.

SUBJECT MATTER OF THE INVENTION

The present invention relates to a trigger safety device of a firearm, in particular of a pistol.

BACKGROUND OF THE INVENTION

It is known in the field of firearms to propose a safety blocking the trigger when the weapon is not in use. In the case of handguns, where the weapon is held in a single hand, the risks of falls are high, in particular under combat conditions. As a result, it is useful to secure the trigger against risks of accidental firing, even when the safety is not engaged. Indeed, when the safety is not engaged, the risk of accidental firing in case of fall is non-negligible.

Patent document WO 2015/157753 describes a safety system in which a two-part trigger makes it possible to block the latter in the absence of pressure from the finger on the inner part of the trigger. This device nevertheless has the drawback of having two bearing surfaces on the shooter's finger, with risks of pinching and of significant dirtying of the device. The dirtying is even more significant given that both parts of the trigger are directly accessible from the outside. In case of blocking between the two parts of the trigger, the actuation thereof is made impossible.

SUMMARY OF THE INVENTION

A first aspect of the invention relates to a firearm comprising a trigger safety, said firearm comprising a frame and a trigger commanding firing, the trigger being positioned on a trigger axis positioned on a trigger lever commanding an ignition chain, said trigger lever being positioned on a trigger lever axis fixed to the frame (or a framework integrated into said frame), said trigger lever being able to switch from an idle position to a position triggering a shot and said trigger being able to switch from an idle position where the trigger bears on the trigger lever on a first bearing surface and a firing position where the trigger bears on the trigger lever on a second bearing surface, resilient means keeping the trigger in the idle position when no pressure is applied thereto, characterized in that said trigger comprises a trigger blocking surface bearing on a corresponding blocking element on the frame blocking the rotation of the trigger lever when the trigger is idle and said trigger blocking surface retracting when the trigger rotates on its axis relative to the trigger lever, freeing the rotation of the trigger lever.

Preferably, the trigger axis passes through the center of gravity of the trigger, such that an impact cannot cause a force moment causing the rotation of the trigger with respect to the trigger lever, thus preventing an accidental shot.

Advantageously, the frame comprises a polymer framework support and a metal framework, the blocking element being positioned on the metal framework. Preferably, the trigger lever is also positioned on said metal framework.

Preferably, the trigger lever comprises several anchoring points to an ignition rod belonging to the ignition chain, so as to make it possible to vary the effective length of the trigger lever.

Preferably, the trigger lever comprises, on its front surface, a notch in which a blocking crosshead fastened to the frame can engage so as to block the trigger in the idle position.

LEGEND OF THE FIGURES

Figure 1:
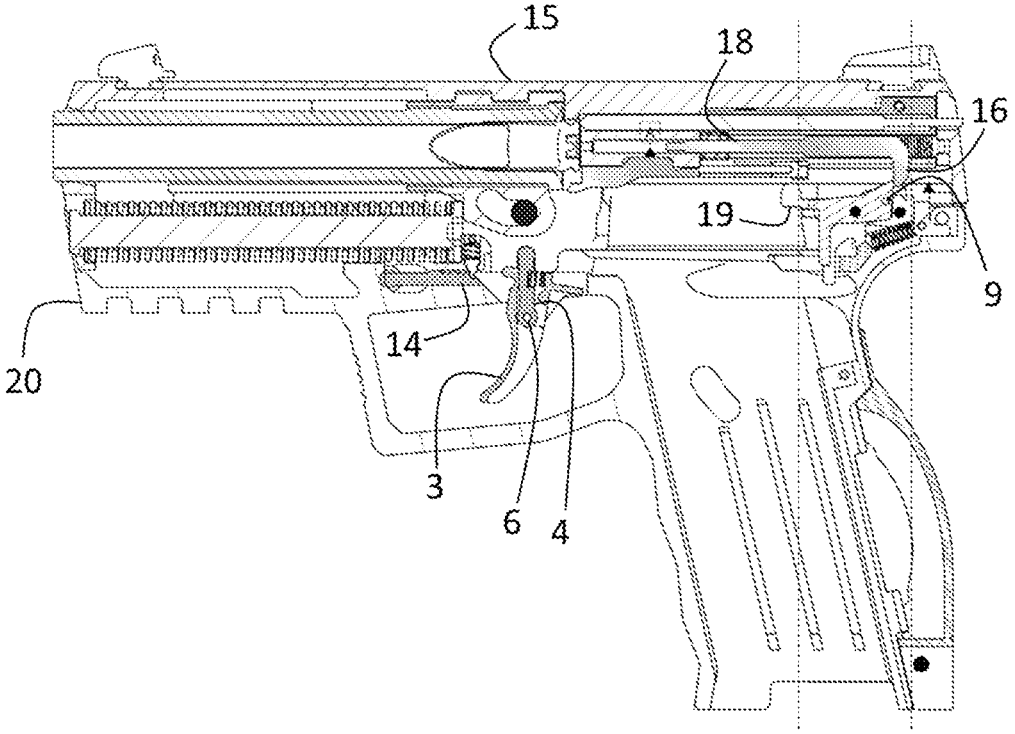
FIG. 1 shows an example longitudinal cross-section of a firearm according the invention.
Figure 2:
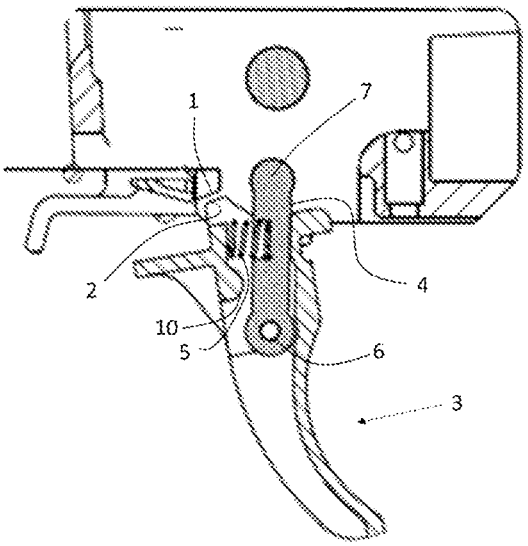
FIG. 2 shows a detail of the trigger system of FIG. 1 in the idle position.
Figure 3:
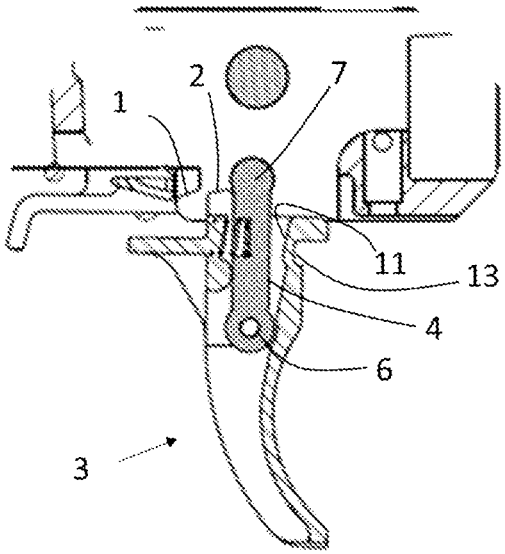
FIG. 3 shows a detail of the trigger system of FIG. 1 in the firing position.
Figure 4:
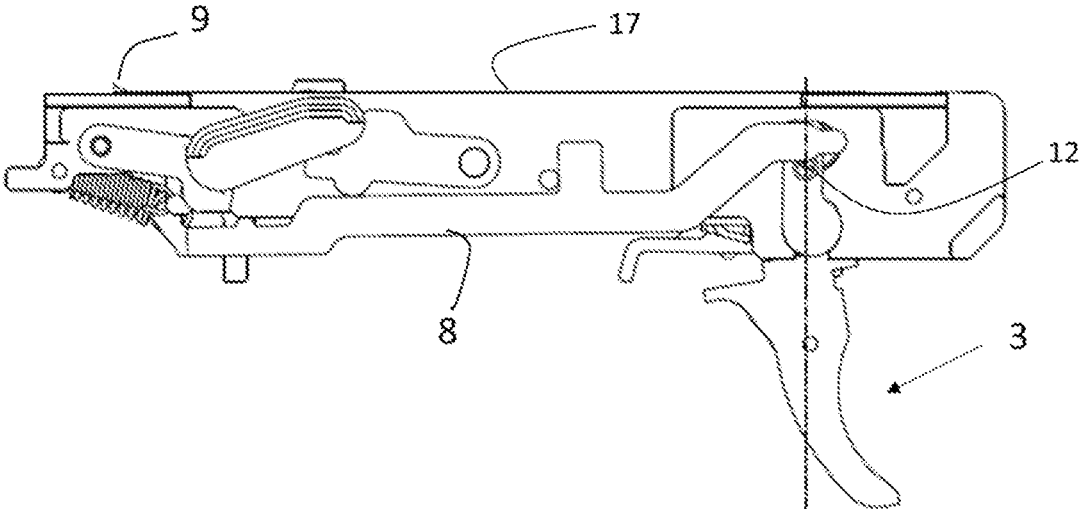
FIG. 4 shows a side view of a metal framework of a firearm according to the invention, with the trigger, the trigger lever and the ignition rod.

1. Trigger blocking element on the framework
2. trigger blocking surface
3. trigger
4. trigger lever
5. trigger return spring
6. trigger axis
7. trigger lever axis
8. ignition rod
9. firing pin trigger
10. trigger bearing surface on the trigger lever (in the firing position)
11. trigger bearing surface on the trigger lever (in the idle position)
12. additional anchoring points to the ignition rod
13. blocking notch of the trigger
14. trigger blocking crosshead
15. slide
16. firing pin stop
17. metal framework
18. firing pin
19. firing pin safety trigger
20. framework support

DETAILED DESCRIPTION OF THE INVENTION

The present description essentially describes an example weapon implementing all the aspects of the present invention. The skilled person will easily understand that the various aspects of the invention, although usable separately, have synergies that will appear clearly in light of this example and several described variants.

A solid is said to be balanced when it rotates about a fixed axis if its center of mass is on the axis of rotation, and preferably if its axis of rotation is a main axis of inertia for this solid.

In the present description, the frame refers to the element used for gripping and comprising the fastening elements for the various elements comprised in the lower part of the weapon, as well as the fastening elements for the moving parts. It may be a conventional frame or a frame incorporating a separate framework, which may or may not be removable from the rest of the frame.

The present invention relates to a safety device blocking the trigger 3 of a firearm, in particular a pistol, preventing the movement of the trigger 3 in the absence of pressure thereon. Unlike the prior art, said device is integrated into a cavity inside the trigger 3. The trigger 3 is advantageously fixed rotating on an axis 6 at the lower end of a trigger lever 4 positioned in the cavity inside the trigger 3. The trigger 3 can then switch from an idle position where it bears by a front surface 11 of its cavity on the trigger lever 4 to a firing position where the trigger 3 bears by a rear surface 10 of its cavity on the trigger lever 4.

In the firing position, the pressure on the trigger 3 applies a torque on the trigger lever 4 between the trigger axis 6 and the rear surface 10 of the trigger, causing the trigger lever to rotate about its axis 7, which causes a translation of the ignition rod 8 triggering the movement of the firing pin 18 trigger 9, releasing the latter and triggering the shot.

The trigger is secured to a blocking surface 2, which, when the trigger is idle, can bear on a surface 1 of the frame, preventing the rotation of the trigger lever 4. The bearing surfaces 1, 2 are positioned such that only a rotation of the trigger 3 relative to the trigger lever 4 makes it possible to unblock the latter.

The advantage of such an arrangement is to at least partially protect the safety device from dirtying, to prevent any pinching of the shooter's skin and to improve the ergonomics of the shooting by only having to press on a single bearing surface.

Advantageously, the trigger is kept in the idle position by resilient means, such as, preferably, a spring 5 or a spring leaf (not shown).

Advantageously, so as to prevent the inertia of the trigger 3 from causing a rotation thereof during a fall, the trigger is balanced on its axis (i.e., its center of mass is on its axis of rotation 6 and preferably the axis of rotation 6 is a main axis of inertia of the trigger 3).

Preferably, the frame is formed by a support 20 made from plastic and a metal framework 17 to which the essential parts of the mechanism of the frame are fastened (slide rails, ignition mechanism, safeties, etc.), the bearing surface 1 of the frame being secured to the framework 17 rather than the plastic support, the dimensional constraints being better controlled on the framework.

Advantageously, the trigger comprises, on its front face, a notch 13 cooperating with a crosshead 14 making it possible to block the rotational movement of the trigger (blocking safety of the trigger).

The invention claimed is:

1. A firearm comprising a trigger safety, said firearm comprising a frame and a trigger, the trigger being positioned on a trigger axis positioned on a trigger lever commanding an ignition chain, said trigger lever being positioned on a trigger lever axis fixed to the frame, said trigger lever being able to switch from an idle position to a position triggering a shot and said trigger being able to switch from an idle position where the trigger bears on the trigger lever on a first bearing surface and a firing position where the trigger bears on the trigger lever on a second bearing surface, resilient means keeping the trigger in the idle position when no pressure is applied thereto, characterized in that said trigger comprises a trigger blocking surface bearing on a corresponding blocking element on the frame blocking the rotation of the trigger lever when the trigger is idle and said trigger blocking surface retracting when the trigger rotates on its axis relative to the trigger lever, freeing the rotation of the trigger lever.

2. The firearm according to claim 1, wherein the trigger is balanced on its axis, such that an impact cannot cause a force moment causing the rotation of the trigger with respect to the trigger lever, thus preventing an accidental shot.

3. The firearm according to claim 1, wherein the frame comprises a polymer framework support and a metal framework, the blocking element being positioned on the metal framework.

4. The firearm according to claim 1, wherein the trigger lever comprises several anchoring points to an ignition rod belonging to the ignition chain, so as to make it possible to vary the effective length of the trigger lever.

5. The firearm according to claim 1, wherein the trigger lever comprises, on its front surface, a notch in which a blocking crosshead fastened to the frame can engage so as to block the trigger in the idle position.

* * * * *